US006298208B1

(12) United States Patent
Kawamura et al.

(10) Patent No.: US 6,298,208 B1
(45) Date of Patent: Oct. 2, 2001

(54) TONER CONTAINER FOR AN IMAGE FORMING APPARATUS

(75) Inventors: Yoshihide Kawamura; Fumio Ogata, both of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/489,412

(22) Filed: Jan. 21, 2000

(30) Foreign Application Priority Data

Jan. 25, 1999 (JP) ..... 11-015183

(51) Int. Cl.[7] ..... G03G 15/08
(52) U.S. Cl. ..... 399/262; 399/103; 399/258
(58) Field of Search ..... 399/262, 258, 399/120, 106, 105, 103, 102; 222/DIG. 1, 167, 325; 141/346

(56) References Cited

U.S. PATENT DOCUMENTS

| | | | | |
|---|---|---|---|---|
| 5,557,382 | | 9/1996 | Tatsumi et al. | 399/262 |
| 5,797,073 | | 8/1998 | Russell | 399/260 |
| 5,909,609 | * | 6/1999 | Yahata et al. | 399/258 |
| 5,918,090 | * | 6/1999 | Ichikawa et al. | 399/120 |
| 6,032,013 | * | 2/2000 | Nizawa | 399/262 |

FOREIGN PATENT DOCUMENTS

| | | |
|---|---|---|
| 7005759 | 1/1995 | (JP) . |
| 7020705 | 1/1995 | (JP) . |
| 7199618 | 8/1995 | (JP) . |
| 7295356 | 11/1995 | (JP) . |
| 10149006 | 6/1998 | (JP) . |

* cited by examiner

*Primary Examiner*—Sophia S. Chen
(74) *Attorney, Agent, or Firm*—Cooper & Dunham LLP

(57) ABSTRACT

A toner container for replenishing toner stored therein to a developing section included in an image forming apparatus includes a body formed with a spiral groove in its inner periphery and coaxially rotatably supported by a replenishing portion via a seal member. The replenishing portion has a toner outlet in its circumferential wall that is selectively blocked or unblocked. While the body is in rotation, the spiral groove conveys toner toward the replenishing portion with the result that the toner is replenished to the developing section via the toner outlet.

92 Claims, 8 Drawing Sheets

TONER CONTAINER FOR AN IMAGE FORMING APPARATUS

BACKGROUND OF THE INVENTION

The present invention relates to a toner container for replenishing toner to a developing section included in a copier, printer, facsimile apparatus or similar electrophotographic image forming apparatus.

Generally, an electrophotographic image forming apparatus includes a developing section for developing a latent image electrostatically formed on a photoconductive element with toner. A toner container for replenishing toner to the developing section has been proposed in various forms in the past. Japanese Patent Laid-Open Publication Nos. 7-5759 and 7-20705, for example, each disclose a toner container including a hollow cylindrical body. The body has a mouth or toner outlet at one end thereof and is formed with a spiral groove in its circumferential wall. An inner cap is fitted in the mouth in order to close the mouth. An outer cap is screwed onto the outer periphery of the mouth over the inner cap in order to prevent the inner cap stopping the mouth from slipping out. This is successful to convey the toner stored in the body to the mouth while agitating it without resorting to an agitator otherwise positioned in the body and therefore to prevent the toner from cohering.

However, the problem with the above conventional toner container is that it is troublesome to deal with the inner cap and outer cap. Particularly, when the toner container is mounted to or dismounted from the developing section, the toner is apt to leak from the container and contaminate surroundings.

Japanese Patent Laid-Open Publication No. 10-149006 teaches a toner container not including an inner cap or an outer cap. Specifically, the toner container is formed with a toner outlet in its circumferential wall. An agitator is disposed in the container for conveying toner stored in the container to the toner outlet while agitating it. This kind of toner container has a problem that it needs a sophisticated structure including the toner outlet and agitator and is difficult to produce and expensive.

SUMMARY OF THE INVENTION

It is therefore an object of the present invention to provide a toner container capable of preventing toner from leaking and contaminating surroundings and capable of feeding the toner stably to the developing section of an image forming apparatus with a simple structure.

In accordance with the present invention, in a toner container including a body and a replenishing portion for replenishing toner stored in the container to a developing device, the body is hollow cylindrical and formed with a spiral groove in its inner circumferential surface while the replenishing portion is hollow cylindrical and formed with an openable toner outlet in its circumferential wall. The body includes a mouth coaxially rotatably supported by the replenishing portion via a seal member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
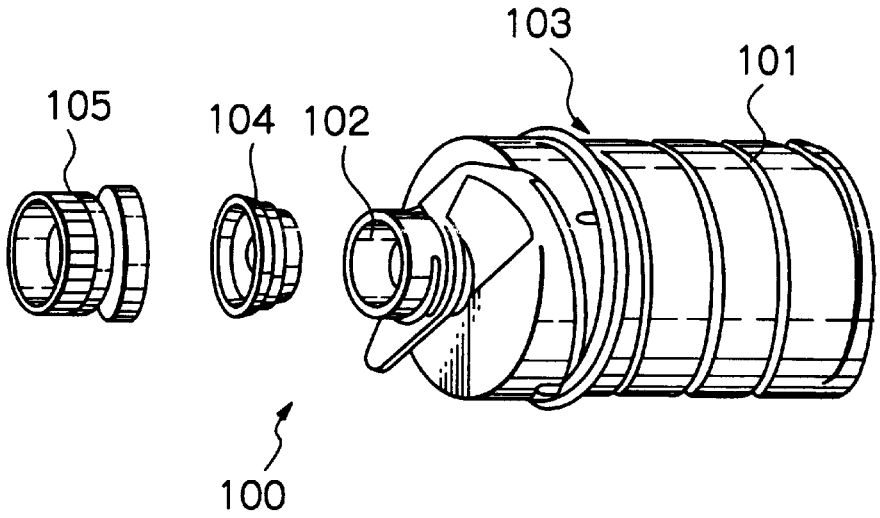
Fig. 1 PRIOR ART
FIG. 1 is an exploded isometric view showing a conventional toner container.

To better understand the present invention, brief reference will be made to a conventional toner container for an image forming apparatus, shown in FIG. 1. The toner container to be described is of the kind taught in, e.g., Laid-Open Publication Nos. 7-5759 and 7-20705 mentioned earlier. As shown, the toner container, generally 100, includes a hollow cylindrical body 103 formed of plastics. The body 103 has a mouth or toner outlet 102 at one end thereof and is formed with a spiral groove 101 in its circumferential wall. An inner cap 104 is fitted in the mouth 102 in order to close the mouth 102. During storage or transport, i.e., before the toner container 100 is mounted to the developing section of an image forming apparatus, an outer cap 105 is screwed onto the outer periphery of the mouth 102 over the inner cap 104 in order to prevent the inner cap 104 stopping the mouth 102 from slipping out. To mount the toner container to the developing section, the outer cap 105 is removed from the body 103, and then the body 103 is set at a preselected position on the developing section. Then, an inner cap fitting/unfitting mechanism built in the image forming apparatus automatically removes the inner cap 104 from the mouth 102. In this condition, the body 103 is rotated about its axis to feed toner stored therein to the developing section via the mouth 102. This is successful to convey the toner stored in the body 103 to the mouth 102 while agitating it without resorting to an agitator otherwise positioned in the body 103. The toner is therefore prevented from cohering.

When the body 103 runs out of the toner (toner end condition), the apparatus displays a message showing the toner end condition on its display. When the operator, watching the message, brings the body 103 to a preselected position for removal, the fitting/unfitting mechanism again fits the inner cap 104 in the mouth 102 and thereby stops the mouth 102. The operator then removes the toner container 100 from the apparatus and fits the outer cap 106 on the mouth 102 in order to prevent the toner left in the container 100 from leaking.

The above toner container 100 including the inner cap 104 and outer cap 105 has the following problems left unsolved. First, the operator removed the outer cap 105 from the container 100 before mounting the container 100 to the developing section is apt to lose it. The container 100 would then be stored or transported without the outer cap 105 after the removal from the developing section. Second, the inner cap 104 is loosely fitted in the mouth 102, so that it can be automatically attached and detached from the mouth 102. It follows that when the container 100 is stored or transported without the outer cap 105, the toner left in the body 103 is apt to leak via a gap between the mouth 102 and the inner cap 104, smearing surroundings including the floor and operator's cloths. Of course, should the inner cap 104 accidentally slip out of the mouth 102, more toner would flow out of the container 100 and smear surroundings.

Figure 2:
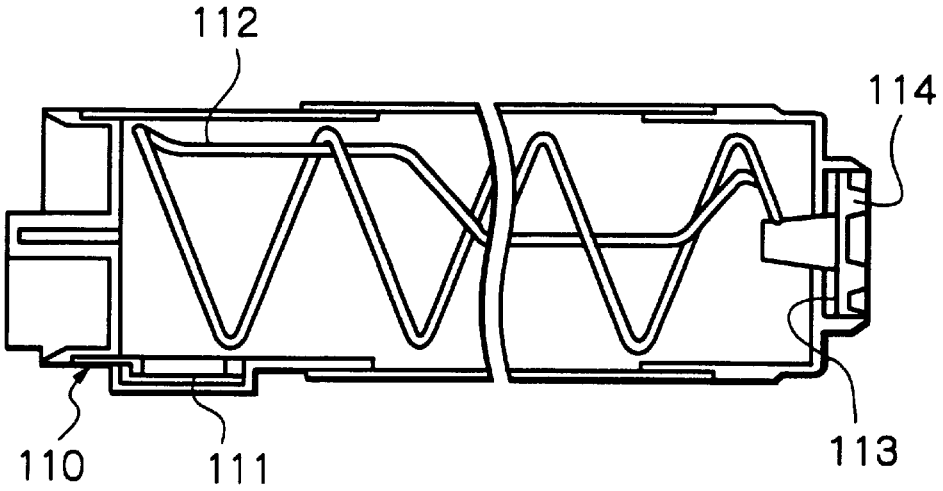
Fig. 2 PRIOR ART
FIG. 2 is a section showing another conventional toner container.

FIG. 2 shows another conventional toner container not including an inner cap or an outer cap, as disclosed in Laid-Open Publication No. 10-149006 also mentioned earlier. As shown, the toner container, generally 110, is formed with a toner outlet 111 in its circumferential wall. An agitator 112 is disposed in the container 110 for conveying toner stored in the container 110 to the toner outlet 111 while agitating it. A gear 114 is mounted on the outside of one end wall of the container 110 via a seal member 113 for driving the agitator 112. The problem with this kind of toner container 100 is that it needs a sophisticated structure including the toner outlet 111 and agitator 112 and is difficult to produce and expensive.

Figure 3:
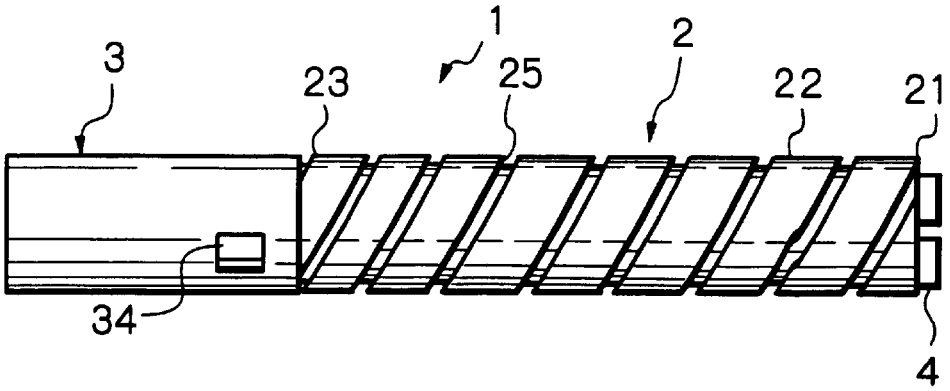
FIG. 3 is a side elevation showing a toner container embodying the present invention.
Figure 4:
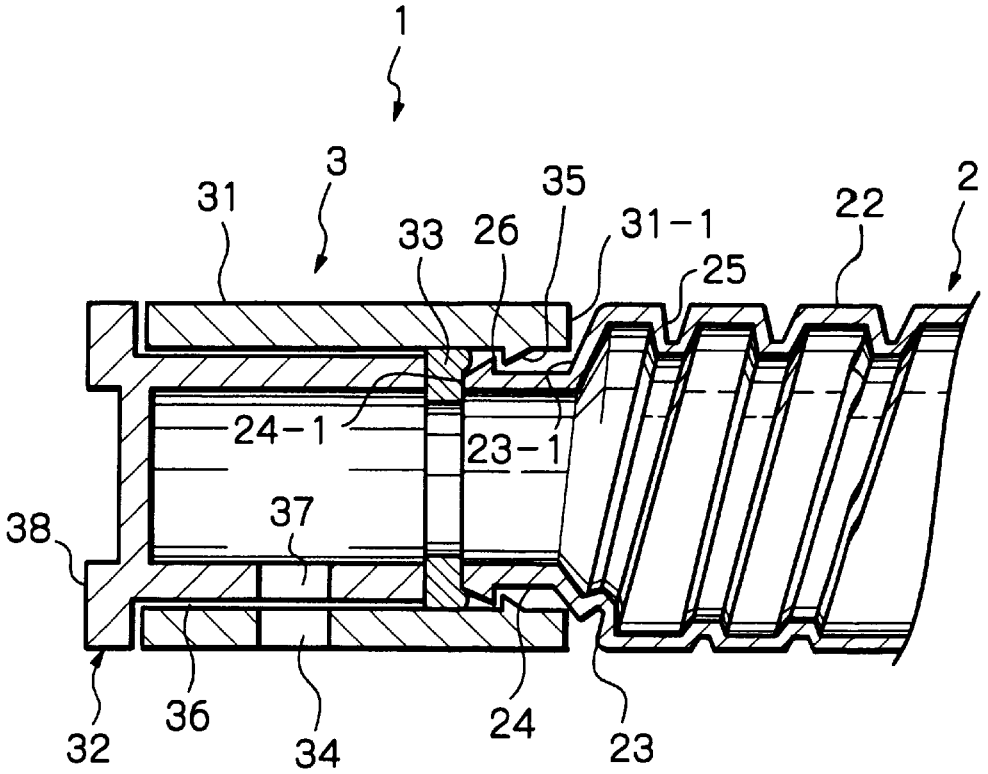
FIG. 4 is a fragmentary section of the illustrative embodiment.

Referring to FIGS. 3 and 4, a toner container embodying the present invention is shown and generally designated by the reference numeral 1. As shown, the toner container 1 is made up of a body 2 and a replenishing portion 3. The body 2 is formed of synthetic resin and has a bottom 21, a circumferential wall 22, a shoulder 23, and a mouth 24. The body 2 has its bottom 21 mounted to a developing section included in a copier or similar image forming apparatus. Drive transmitting means 4 is arranged on the bottom 21 to be operatively connected to drive means included in the developing section. The drive transmitting means 4 may be implemented by a gear or a cam by way of example. The replenishing portion 3 is fitted on the mouth 24 located at the other end of the body 2. The circumferential wall 22 of the body 2 is formed with a spiral groove 25 convex toward the inner periphery of the body 2. A hook 26 protrudes outward from the outer periphery of the tip of the mouth 24.

The replenishing portion 3 is made up of an outer sleeve 31, an inner sleeve 32, and a seal member 33. The outer sleeve 31 is hollow cylindrical and formed with a toner outlet 34 in its circumferential wall. A plurality of lugs 35 protrude from the inner periphery of part of the outer sleeve 31 adjoining the body 2, constituting a locking portion. The lugs 35 should preferably have a configuration shown in FIG. 5 that is an end view as seen from the body 2 side. As shown, the lugs 35 each have a substantially trapezoidal configuration whose top and sides smoothly merge into each other without any edge.

Figure 6A:
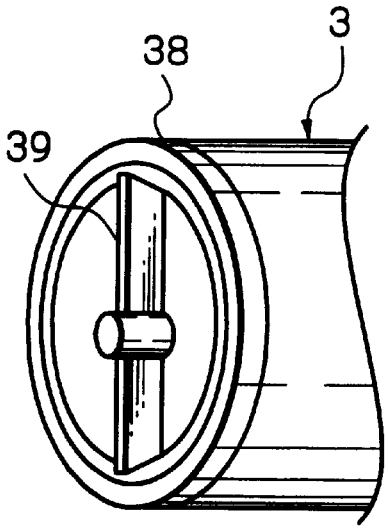
FIGS. 6A and 6B are fragmentary isometric views each showing a particular configuration of a flange forming part of an inner sleeve included in the replenishing portion.
Figure 6B:
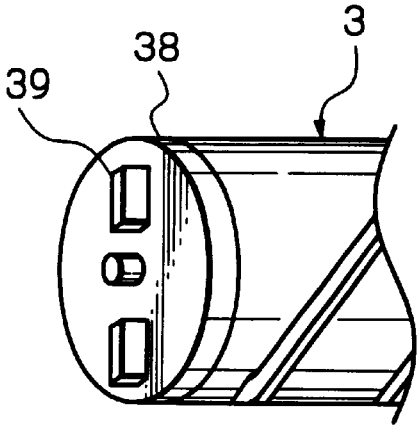

The inner sleeve 32 is hollow cylindrical and has its one end closed by a flange 38. A cylindrical portion 36 included in the inner sleeve 32 is received in the outer sleeve 31. A toner outlet 37 is formed in the cylindrical portion 36 and corresponds in position to the toner outlet 34 of the outer sleeve 31. A grip is positioned at the center of the outer surface of the flange 38 and is implemented by a recess or a projection 39 shown in FIG. 6A or projections 39 shown in FIG. 6B. After the inner sleeve 32 has been inserted in the outer sleeve 31, the inner sleeve 32 can be rotated by nipping the grip 39. The seal member 33 is annular and formed of rubber or urethane foam or similar elastic synthetic resin.

The above toner container 1 is assembled by the following procedure. After the seal member 33 has been positioned in the outer sleeve 31 of the replenishing portion 3, the wall 36 of the inner sleeve 32 is inserted into the outer sleeve 31 from the end of the sleeve 31 opposite to the lugs 35. As a result, the inner sleeve 32 and seal member 33 each are fixed in a respective preselected position. If desired, the seal member 33 may be fixed to the preselected position of the outer sleeve 31 by adhesive or a two-sided adhesive tape beforehand or may be fitted in a groove formed in the above position of the outer sleeve 31 beforehand. Subsequently, the mouth 24 of the body 2 is inserted into the outer sleeve 31 from the end of the sleeve 31 where the lugs 35 are positioned, causing the tip of the mouth 24 to abut against the seal member 33. Consequently, the hook 26 of the mouth 24 is caught by the lugs 35 of the outer sleeve 31, so that the body 2 is rotatably locked to the outer sleeve 31.

Figure 5:
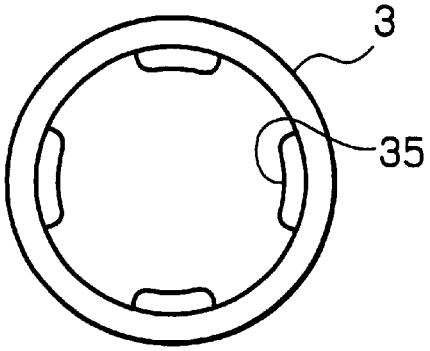
FIG. 5 is an end view of an outer sleeve forming part of a replenishing portion included in the illustrative embodiment.
Figure 7:
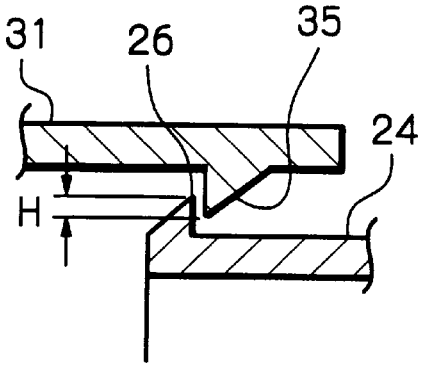
FIG. 7 is a fragmentary section showing how a hook formed on a body also included in the illustrative embodiment and projections formed on the outer sleeve overlap each other.

It is noteworthy that if the lugs 35 are free from edges, as stated earlier with reference to FIG. 5, they allow the body 2 to smoothly rotate relative to the outer sleeve 31 without scratching the surface of the mouth 24. As shown in FIG. 7, assume that the lugs 35 and hook 26 over lap each other by a dimension H when the outer sleeve 31 and body 24 are connected together. Then, the dimension H should preferably be 0.9±0.5 mm to allow the body 2 to be easily mounted to the outer sleeve 31 and to surely prevent the former from slipping out of the latter.

When the tip, labeled 24-1, of the mouth 24 is pressed against the flexible seal member 33, the seal member 33 yields and allows the tip 24-1 to be easily fixed in place. However, should the pressure acting on the seal member 33 be excessively high, the seal member 33 would yield to an excessive degree and would therefore be deteriorated. In light of this, the distance between the end, labeled 31-1, of the outer sleeve 31 and a portion 23-1 of the shoulder 23 closest to the end 31-1 may be so adjusted as to prevent a pressure higher than a pressure which would occur if the end 31-1 and portion 23-1 were brought into contact from acting on the seal member 33.

To fill the toner container 1 assembled by the above procedure with toner, the inner sleeve 32 is rotated until the projection or projections 39 align with a preselected mark, causing the toner outlet 37 of the inner sleeve 32 and the toner outlet 34 of the outer sleeve 31 align with each other. In this condition, toner is introduced into the body 2 via the aligned toner outlets 34 and 37. After the body 2 has been filled with toner, the inner sleeve 32 is again rotated to bring its toner outlet 37 out of alignment with the toner outlet 34 of the outer sleeve 31. As a result, the inner sleeve 32 stops the toner outlet 34 of the outer sleeve 31 with its wall 36.

Figure 8:
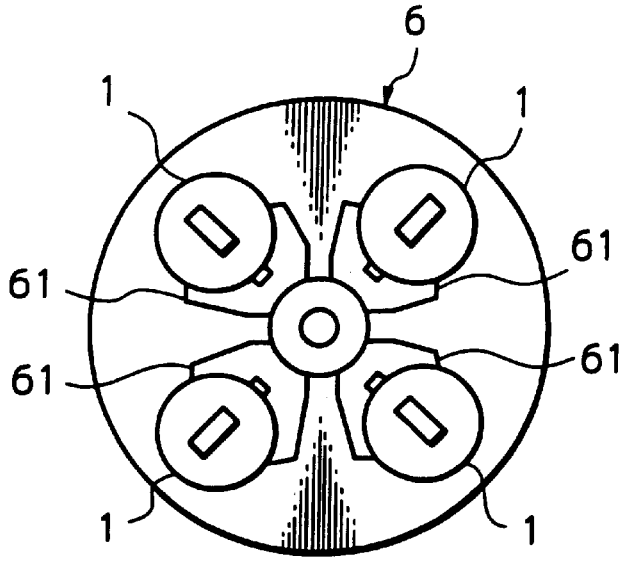
FIG. 8 is a side elevation showing a developing section included in an image forming apparatus and loaded with toner containers each having the configuration of the illustrative embodiment.

FIG. 8 shows a specific revolver type developing unit 6 included in an image forming apparatus. Toner containers 1 each having the above configuration are inserted into developing sections 61 arranged in the developing unit 6, as follows. Each container 1 is inserted into a particular developing section 61 with the drive transmitting means 4 facing the developing section 61 until the drive transmitting means 4 has been operatively connected to a drive section arranged in the developing section 61. Subsequently, the toner outlet 34 of the outer sleeve 31 is positioned, and then the outer sleeve 31 is locked to the developing section 61. Further, the inner sleeve 31 is rotated to cause its toner outlet 37 to align with the toner outlet 34 of the outer sleeve 31 and then locked to the developing section 61.

During development, the developing unit 6 with the toner containers 1 is rotated by each one-quarter of a rotation. The rotation of the drive section assigned to each developing section 61 is transferred to the drive transmitting means 4 of the toner container 1 positioned in the above developing section 61, causing the body 2 of the container 1 to rotate. While the body 2 is in rotation, the spiral groove 25 formed in the circumferential wall 22 of the body 2 also rotates. As a result, the toner stored in the body 2 is sequentially conveyed toward the replenishing portion 3 and then replenished to the developing section 61 via the aligned toner outlets 37 and 34.

The toner is replenished to the developing section 61 via the c circumferential wall of the toner container 1, as stated above. This implements direct toner replenishment from the container 1 to the developing section 61 without the intermediary of a relay portion or a guide portion and thereby successfully reduces the size of the developing section 61.

Further, because the toner is conveyed toward the replenishing portion 3 by the rotation of the body 2, it is not necessary to dispose an agitator for conveying the toner in the body 2. The toner container 1 is therefore simple in structure, easy to produce, and low cost.

Moreover, because the toner is conveyed toward the replenishing portion 3 by the rotation of the spiral groove 25 of the body 2, the toner being conveyed is free from local pressures and therefore cohesion and degeneration ascribable to the rotation of an agitator. Such toner insures high quality images.

In addition, after the collection of the used toner container 1, the body 2 and replenishing portion 3 thereof can be easily separated from each other for a cleaning purpose or a recycling purpose.

While the illustrative embodiment conveys the toner by using the spiral groove 25 of the circumferential wall 22 of the body 2, the spiral groove 25 may be replaced with a spiral rib formed on the inner periphery of the wall 22, if desired.

Figure 9:
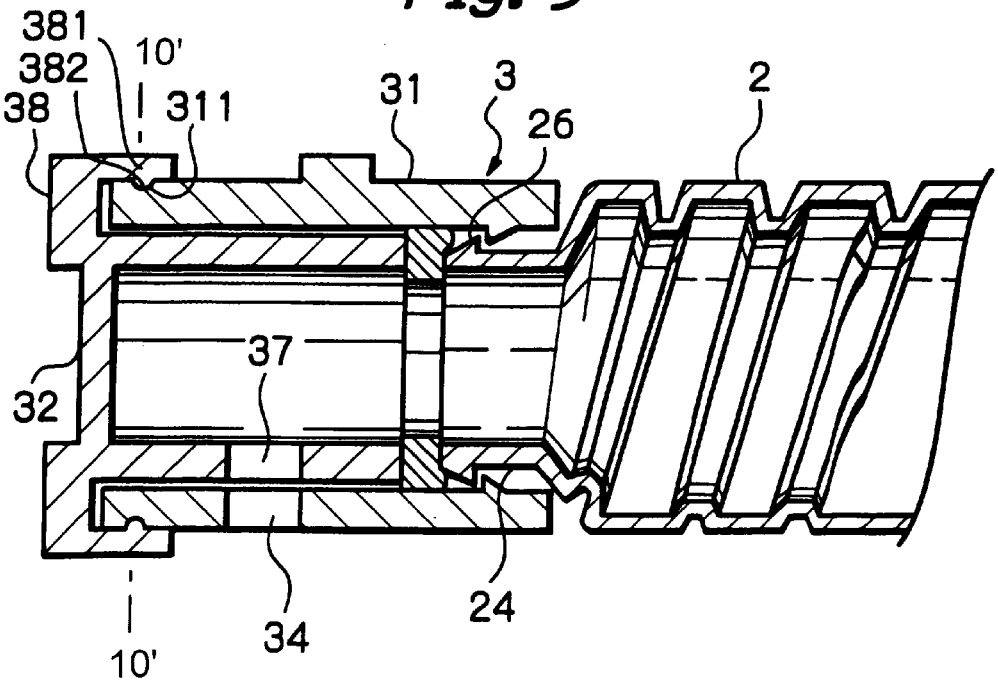
FIG. 9 is a section showing an alternative embodiment of the present invention.
Figure 10:
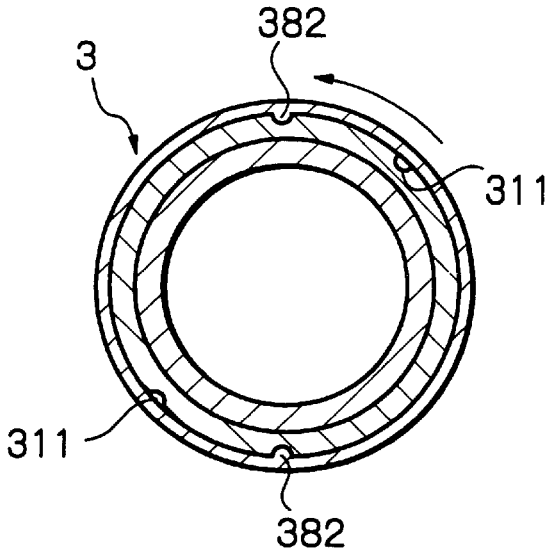
FIG. 10 is a section along line-A of FIG. 9.

An alternative embodiment of the present invention will be described with reference to FIGS. 9 and 10. In the previous embodiment, to bring the toner outlet 37 of the inner sleeve 32 and the toner outlet 34 of the outer sleeve 31 into alignment, the lug or lugs 39 is brought into alignment with a preselected mark. In this embodiment, as shown in FIGS. 9 and 10, an annular wall 381 extends from the flange 38 of the inner sleeve 32 and is engageable with the outer periphery of the outer sleeve 31. Two or more positioning lugs 382 protrude from the inner periphery of the annular wall 381. Dents 311 representative of an open position where the two toner outlets 34 and 37 are aligned and a closed position where the toner outlet 34 is stopped by the inner sleeve 32 are formed in the outer periphery of the outer sleeve 31. The lugs 382 and dents 311 are used to selectively align the toner outlets 37 and 34 or stop the toner outlet 34. This successfully prevents the toner from leaking from the toner container 1 due to shocks and impacts while in transport.

Figure 11:
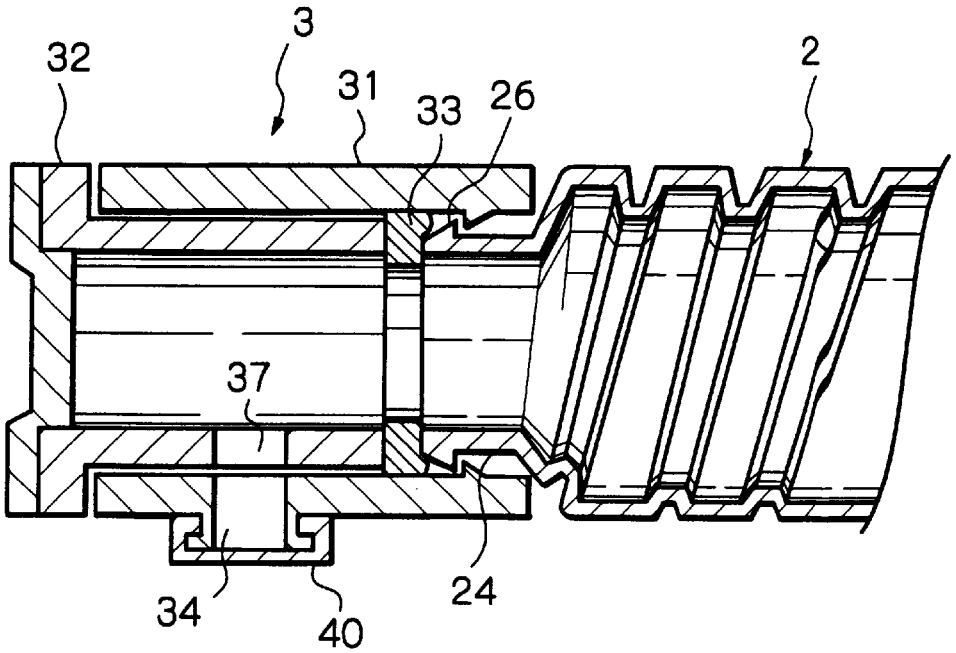
FIG. 11 is a fragmentary section showing another alternative embodiment of the present invention.
Figure 12:
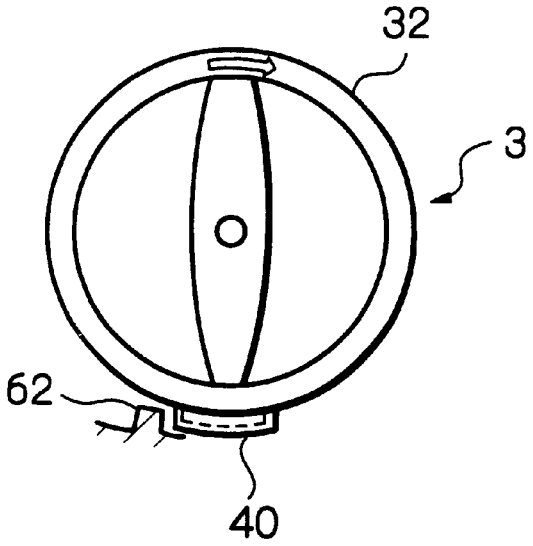
FIG. 12 is an end view of a toner replenishing section included in the embodiment of FIG. 11.
Figure 13:
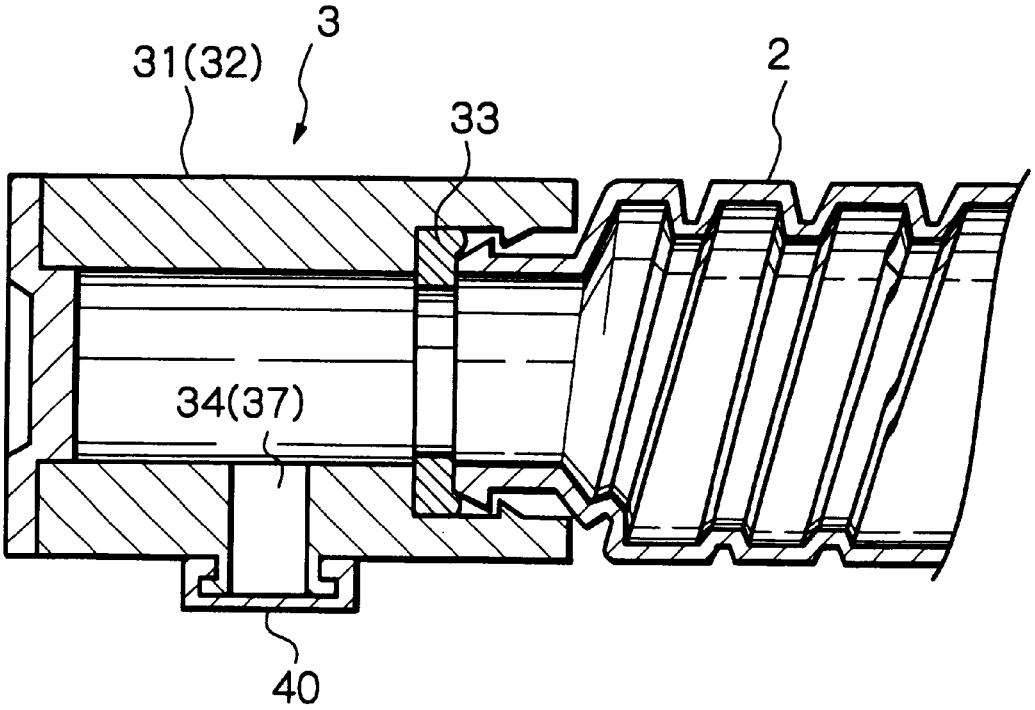
FIG. 13 is a fragmentary section showing still another alternative embodiment of the present invention.
Figure 14:
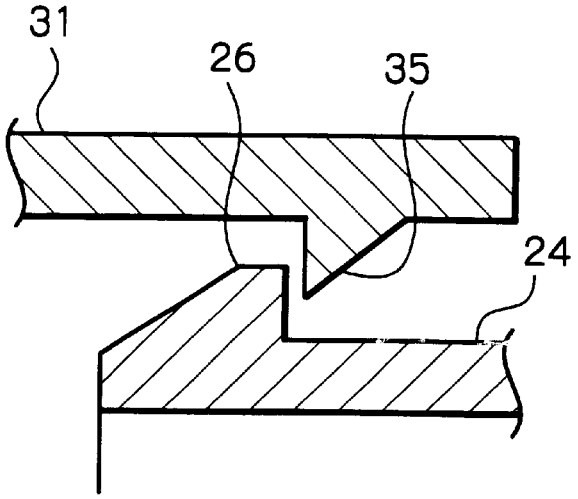
FIG. 14 is a fragmentary section showing a modification of the hook included in any one of the illustrative embodiments.

FIGS. 11 and 12 show another alternative embodiment of the present invention. In the foregoing embodiments, the inner sleeve 32 is rotated to selectively align the toner outlets 37 and 34 or stop the toner outlet 34. In this embodiment, as shown in FIGS. 11 and 12, the inner sleeve 32 is fixed to the outer sleeve 31 with the toner outlet 34 aligning with the toner outlet 34. A shutter 40 is mounted on the outer periphery of the outer sleeve 31 to close the toner outlet 34. As shown in FIG. 12, when the toner container 1 with the shutter 40 is mounted to the developing section 61, FIG. 8, a shutter opening mechanism 62 arranged in the developing section 61 automatically opens the shutter 40. FIG. 14 shows a further alternative embodiment of the present invention in which the inner sleeve 32 and outer sleeve 31 are molded integrally with each other. This can be done because of the shutter 40.

FIG. 14 shows a modification of any one of the foregoing embodiments. In the previous embodiments, the hook 26 formed at the tip of the mouth 24 has a triangular section. In FIG. 14, the hook 26 is provided with a flat end in order to increase the thickness of the portion engageable with the lugs 35 of the outer sleeve 31. With this configuration, it is possible to cause the body 2 to rotate more stably. The edges of the hook 26 should preferably be rounded in order to avoid scratching.

Figure 15:
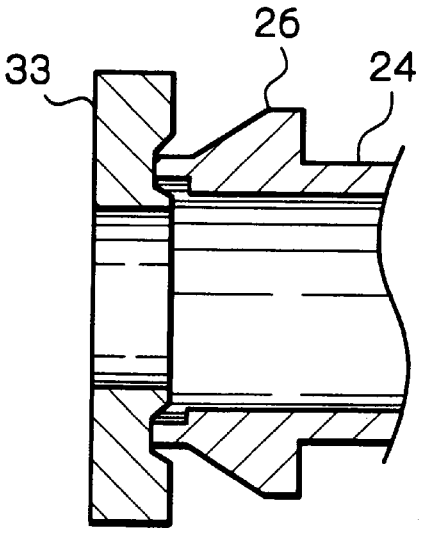
FIGS. 15 and 16 are fragmentary sections each showing a particular modified arrangement in which a mouth included in the body and a seal member contact each other.
Figure 16:
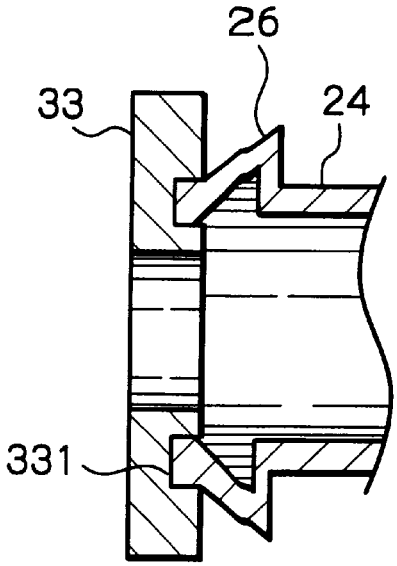

FIG. 15 shows another modification in which the mouth 24 and seal member 33 contact each other within a limited area. FIG. 16 shows another modification in which the tip of the mouth 24 is fitted in a groove 331 formed in the seal member 33. These modifications allow the body 2 to rotate easily.

Figure 17:
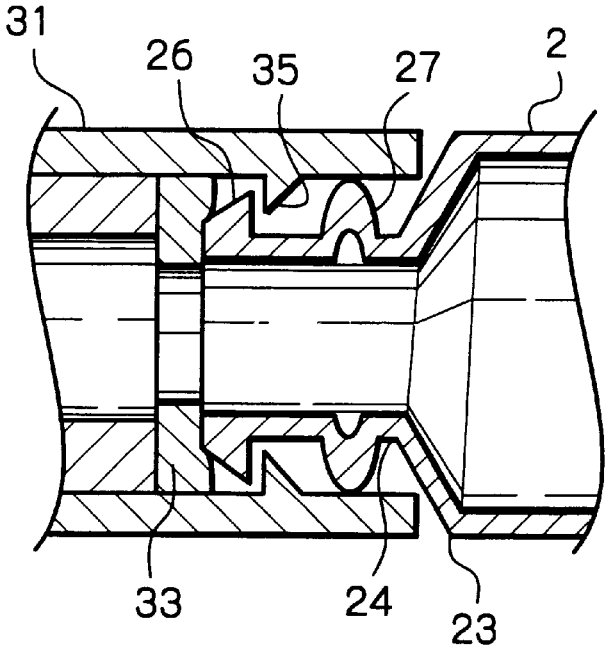
FIG. 17 is a fragmentary section showing a modification of the mouth.

FIG. 17 shows still another modification in which an annular rib 27 protrudes from the position of the mouth 24 closer to the shoulder 23 than the lugs 35 of the outer sleeve 31. The rib 27 contacts the inner periphery of the outer sleeve 31 and further promotes the stable rotation of the body 2. In addition, the rib 27 surely prevents the toner from leaking via the gap between the body 2 and the replenishing portion 3.

Figure 18:
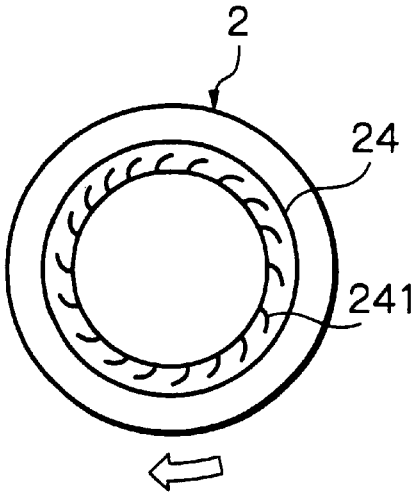
FIG. 18 is an end view showing a specific configuration of the surface of the mouth expected to contact the seal member.

FIG. 18 shows yet another modification in which radial or spiral grooves 241 are formed in the surface of the mouth 24 expected to contact the seal member 33 and extend in the direction of rotation of the body 2. While the body 2 is in rotation, the toner flows inward along the grooves 241 and is more surely prevented from leaking via the gap between the body 2 and the replenishing portion 3.

Figure 19:
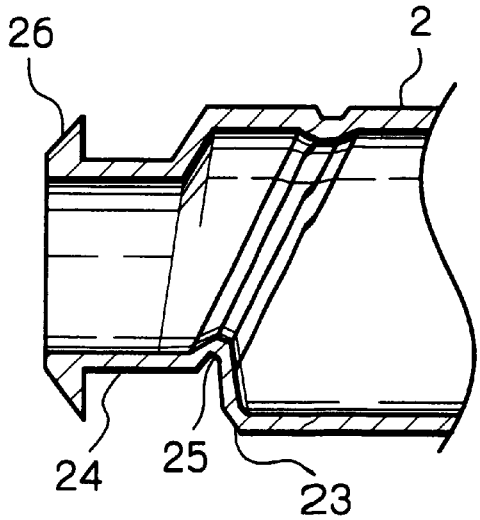
FIG. 19 is a fragmentary section showing a modified configuration of a spiral groove formed in the body.

FIG. 19 shows a further modification in which the inside diameter of the spiral groove 25 is made smaller than the inside diameter of the mouth 24 at a boundary between the shoulder 23 and the mouth 24. This is successful to surely move the toner to the mouth 24 by the rotation of the body 2 and therefore to replenish the entire toner existing in the body 2, i.e., to reduce the amount of toner to remain in the body 2.

If desired, the replenishing portion 3 may be partly or entirely formed of a transparent material. In such a case, a reflection type or a transmission type sensor will be used to sense the toner being transferred from the body 2 to the replenishing portion 3 for thereby determining the amount of toner remaining in the toner container 1.

While the body 2 should preferably be cylindrical, it may be conical, if desired. In any case, the drive transmitting means should be provided along the axis of a cylinder or a cone in order to cause the body 2 to rotate. The drive transmitting means may be formed integrally with or separately from the body 2, as desired.

In summary, it will be seen that the present invention provides a toner container for an image forming apparatus having various unprecedented advantages, as enumerated below.

(1) A body included in the toner container is formed with a spiral groove in its inner periphery and coaxially rotatably supported by a replenishing portion via a seal member. The replenishing portion has a toner outlet in its circumferential wall that is selectively blocked or unblocked. While the body is in rotation, the spiral groove conveys toner toward the replenishing portion with the result that the toner is replenished to a developing device via the toner outlet. This implements direct toner replenishment from the container to the developing device without the intermediary of a relay portion or a guide portion and thereby successfully reduces the size of the developing device.

(2) Because the toner is conveyed toward the replenishing portion by the rotation of the body, it is not necessary to dispose an agitator for conveying the toner in the body. The container is therefore simple in structure, easy to produce, and low cost.

(3) Because the toner is conveyed toward the replenishing portion by the rotation of the spiral groove of the body, the toner being conveyed is free from local pressures and therefore cohesion and degeneration ascribable to the rotation of an agitator. Such toner insures high quality images.

(4) After the collection of the used container, the body and replenishing portion thereof can be easily separated from each other for a cleaning purpose or a recycling purpose.

(5) An annular hook protrudes from the outer periphery of the tip of a mouth also included in the container. A plurality of lugs engageable with the hook protrude from the inner periphery of the replenishing portion. This allows the body to be easily attached to or detached from the replenishing portion and insures stable rotation of the body.

(6) The replenishing portion includes an inner sleeve and an outer sleeve. The outer sleeve is cylindrical and formed with the toner outlet in its circumferential wall. The inner sleeve is also cylindrical, but closed by a flange at one end. The cylindrical portion of the inner sleeve is engaged with the inner periphery of the outer sleeve and formed with a toner outlet corresponding in position to the toner outlet of the outer sleeve. The inner sleeve received in the outer sleeve is rotated to bring the two toner outlets into and out of alignment with each other. The toner outlets can therefore be surely opened or closed and insure stable toner replenishment the developing device.

(7) The lugs of the outer sleeve each have a generally trapezoidal configuration whose to and sides smoothly join each other without any edge. The lugs therefore allow the body to smoothly rotate without scratching or otherwise damaging the surface of the mouth of the body.

(8) An annular wall extends from the inner sleeve and is coupled over the outer sleeve. A plurality of positioning lugs protrude from the inner periphery of the annular wall. Dents representative of an open position where the two toner outlets align and a closed position where the toner outlet of the outer sleeve is stopped by the inner sleeve are formed in the outer periphery of the outer sleeve. The is successfully prevents the toner from leaking from the container due to shocks and impacts while in transport.

(9) The inner sleeve is fixed to the outer sleeve with its toner outlet aligning with the other toner outlet. A shutter is mounted on the outer periphery of the outer sleeve to close the toner outlet of the outer sleeve. This is also successful to prevent the toner from leaking due to shocks and impacts while in transport and to stably replenish the toner to the developing device. In addition, the shutter allows the inner sleeve and outer sleeve to be molded integrally with each other in order to simplify the configuration of the replenishing portion.

(10) The hook is provided with a flat end in order to increase the thickness of the portion engageable with the lugs of the outer sleeve. With this configuration, it is possible to cause the body to rotate more stably.

(11) The tip of the mouth and the seal member contact each other within a limited area, so that the body 2 can rotate easily.

(12) An annular rib protrudes from the position of the mouth closer to a shoulder than the lugs of the outer sleeve. The rib abuts against the inner periphery of the outer sleeve and further promotes the stable rotation of the body. In addition, the rib surely prevents the toner from leaking via the gap between the body and the replenishing portion.

(13) Radial or spiral grooves are formed in the surface of the mouth expected to contact the seal member and extend in the direction of rotation of the body. While the body is in rotation, the toner flows inward along the grooves and is more surely prevented from leaking via the gap between the body and the replenishing portion.

(14) The inside diameter of the spiral groove is made smaller than the inside diameter of the mouth at a boundary between the shoulder and the mouth. This is successful to surely move the toner to the mouth by the rotation of the body and therefore to replenish the entire toner existing in the body, i.e., to reduce the amount of toner to remain in the body.

(15) The replenishing portion may be partly or entirely formed of a transparent material. In such a case, a reflection type or a transmission type sensor will be used to sense the toner being transferred from the body to the replenishing portion for thereby determining the amount of toner remaining in the container.

Various modifications will become possible for those skilled in the art after receiving the teachings of the present disclosure without departing from the scope thereof.

What is claimed is:

1. In a toner container including a body and a replenishing portion for replenishing toner stored in said toner container to a developing device, said body is hollow cylindrical and formed with a spiral groove in an inner circumferential surface thereof while said replenishing portion is hollow cylindrical and formed with an openable toner outlet in a circumferential wall thereof, said body including a mouth coaxially rotatably supported by said replenishing portion via a seal member, wherein the openable toner outlet is selectively opened and closed by rotating the body and at least part of the replenishing portion relative to each other.

2. In a toner container including a body and a replenishing portion for replenishing toner stored in said toner container to a developing device, said body is hollow cylindrical and formed with a spiral groove in an inner circumferential surface thereof while said replenishing portion is hollow cylindrical and formed with an openable toner outlet in a circumferential wall thereof, said body including a mouth coaxially rotatably supported by said replenishing portion via a seal, wherein an annular hook is formed on an outer periphery of said mouth while a plurality of lugs engageable with said hook are formed in an inner periphery of part of said replenishing portion to be connected to said body.

3. A toner container as claimed in claim 2, wherein said replenishing portion comprises:

a hollow cylindrical outer sleeve formed with a first toner outlet in a circumferential wall thereof; and a hollow cylindrical inner sleeve closed by a flange at one end thereof, and including a circumferential wall engaged with an inner periphery of said outer sleeve, and formed with a second toner outlet corresponding in position to said first toner outlet;

said first toner outlet and said second toner outlet being selectively aligned in accordance with a rotation effected with said inner sleeve being received in said outer sleeve.

4. A tone container as claimed in claim 3, wherein said inner sleeve further includes an annular wall coupled over said outer sleeve and formed with a plurality of positioning lugs on an inner periphery thereof, said outer sleeve being formed with dents representative of an open position where said first toner outlet and said second toner outlet are aligned and a closed position where said first toner outlet is stopped by said inner sleeve in an outer periphery thereof.

5. A toner container as claimed in claim 3, wherein said inner sleeve is fixed to said outer sleeve with said first toner outlet and said second toner outlet aligning with each other, a shutter being mounted on said outer sleeve at an outside of said first toner outlet and engageable with a shutter opening mechanism arranged in the developing device.

6. A toner container as claimed in claim 5, wherein said inner sleeve and said outer sleeve are molded integrally with each other.

7. A toner container as claimed in claim 6, wherein said hook of said body has a flat end and has a portion thereof engageable with said lugs of said outer sleeve increased in thickness.

8. A toner container as claimed in claim 7, wherein said mouth of said body contacts said seal member within a limited area.

9. A toner container as claimed in claim 8, wherein an annular rib is formed on said mouth of said body at a position closer to a shoulder of said body than said lugs of said outer sleeve and is engageable with the inner periphery of said outer sleeve.

10. A toner container as claimed in claim 9, wherein radial or spiral grooves are formed in a surface of said mouth of said body expected to contact said seal member and extend in a direction of rotation of said body, whereby the toner flows inward along said grooves while said body is in rotation.

11. A toner container as claimed in claim 10, wherein said spiral groove of said body has a smaller inside diameter than said mouth at a boundary between said shoulder and said mouth.

12. A toner container as claimed in claim 10, wherein said replenishing portion is at least partly formed of a transparent material.

13. A toner container as claimed in claim 6, wherein said mouth of said body contacts said seal member within a limited area.

14. A toner container as claimed in claim 13, wherein an annular rib is formed on said mouth of said body at a position closer to a shoulder of said body than said lugs of said outer sleeve and is engageable with the inner periphery of said outer sleeve.

15. A toner container as claimed in claim 14, wherein radial or spiral grooves are formed in a surface of said mouth of said body expected to contact said seal member and extend in a direction of rotation of said body, whereby the toner flows inward along said grooves while said body is in rotation.

16. A toner container as claimed in claim 15, wherein said spiral groove of said body has a smaller inside diameter than said mouth at a boundary between said shoulder and said mouth.

17. A toner container as claimed in claim 15, wherein said replenishing portion is at least partly formed of a transparent material.

18. A toner container as claimed in claim 6, wherein an annular rib is formed on said mouth of said body at a position closer to a shoulder of said body than said lugs of said outer sleeve and is engageable with the inner periphery of said outer sleeve.

19. A toner container as claimed in claim 18, wherein radial or spiral grooves are formed in a surface of said mouth of said body expected to contact said seal member and extend in a direction of rotation of said body, whereby the toner flows inward along said grooves while said body is in rotation.

20. A toner container as claimed in claim 19, wherein said spiral groove of said body has a smaller inside diameter than said mouth at a boundary between said shoulder and said mouth.

21. A toner container as claimed in claim 19, wherein said replenishing portion is at least partly formed of a transparent material.

22. A toner container as claimed in claim 6, wherein radial or spiral grooves are formed in a surface of said mouth of said body expected to contact said seal member and extend in a direction of rotation of said body, whereby the toner flows inward along said grooves while said body is in rotation.

23. A toner container as claimed in claim 22, wherein said spiral groove of said body has a smaller inside diameter than said mouth at a boundary between a shoulder of said body and said mouth.

24. A toner container as claimed in claim 22, wherein said replenishing portion is at least partly formed of a transparent material.

25. A toner container as claimed in claim 6, wherein said spiral groove of said body has a smaller inside diameter than said mouth at a boundary between a shoulder of said body and said mouth.

26. A toner container as claimed in claim 6, wherein said replenishing portion is at least partly formed of a transparent material.

27. A toner container as claimed in claim 3, wherein said inner sleeve and said outer sleeve are molded integrally with each other.

28. A toner container as claimed in claim 27, wherein said hook of said body has a flat end and has a portion thereof engageable with said lugs of said outer sleeve increased in thickness.

29. A toner container as claimed in claim 28, wherein said mouth of said body contacts said seal member within a limited area.

30. A toner container as claimed in claim 29, wherein an annular rib is formed on said mouth of said body at a position closer to a shoulder of said body than said lugs of said outer sleeve and is engageable with the inner periphery of said outer sleeve.

31. A toner container as claimed in claim 30, wherein radial or spiral grooves are formed in a surface of said mouth of said body expected to contact said seal member and extend in a direction of rotation of said body, whereby the toner flows inward along said grooves while said body is in rotation.

32. A toner container as claimed in claim 31, wherein said spiral groove of said body has a smaller inside diameter than said mouth at a boundary between said shoulder and said mouth.

33. A toner container as claimed in claim 31, wherein said replenishing portion is at least partly formed of a transparent material.

34. A toner container as claimed in claim 27, wherein said mouth of said body contacts said seal member within a limited area.

35. A toner container as claimed in claim 34, wherein an annular rib is formed on said mouth of said body at a position closer to a shoulder of said body than said lugs of said outer sleeve and is engageable with the inner periphery of said outer sleeve.

36. A toner container as claimed in claim 35, wherein radial or spiral grooves are formed in a surface of said mouth of said body expected to contact said seal member and extend in a direction of rotation of said body, whereby the toner flows inward along said grooves while said body is in rotation.

37. A toner container as claimed in claim 36, wherein said spiral groove of said body has a smaller inside diameter than said mouth at a boundary between said shoulder and said mouth.

38. A toner container as claimed in claim 36, wherein said replenishing portion is at least partly formed of a transparent material.

39. A toner container as claimed in claim 27, wherein an annular rib is formed on said mouth of said body at a position closer to a shoulder of said body than said lugs of said outer sleeve and is engageable with the inner periphery of said outer sleeve.

40. A toner container as claimed in claim 39, wherein radial or spiral grooves are formed in a surface of said mouth of said body expected to contact said seal member and extend in a direction of rotation of said body, whereby the toner flows inward along said grooves while said body is in rotation.

41. A toner container as claimed in claim 40, wherein said spiral groove of said body has a smaller inside diameter than said mouth at a boundary between said shoulder and said mouth.

42. A toner container as claimed in claim 40, wherein said replenishing portion is at least partly formed of a transparent material.

43. A toner container as claimed in claim 27, wherein radial or spiral grooves are formed in a surface of said mouth of said body expected to contact said seal member and extend in a direction of rotation of said body, whereby the toner flows inward along said grooves while said body is in rotation.

44. A toner container as claimed in claim 43, wherein said spiral groove of said body has a smaller inside diameter than said mouth at a boundary between a shoulder of said body and said mouth.

45. A toner container as claimed in claim 43, wherein said replenishing portion is at least partly formed of a transparent material.

46. A toner container as claimed in claim 27, wherein said spiral groove of said body has a smaller inside diameter than said mouth at a boundary between a shoulder of said body and said mouth.

47. A toner container as claimed in claim 27, wherein said replenishing portion is at least partly formed of a transparent material.

48. A toner container as claimed in claim 3, wherein said lugs each have a generally trapezoidal configuration whose top and opposite sides smoothly join each other without any edge.

49. A toner container as claimed in claim 48, wherein said inner sleeve is fixed to said outer sleeve with said first toner outlet and said second toner outlet aligning with each other, a shutter being mounted on said outer sleeve at an outside of said first toner outlet and engageable with a shutter opening mechanism arranged in the developing device.

50. A toner container as claimed in claim 49, wherein said inner sleeve and said outer sleeve are molded integrally with each other.

51. A toner container as claimed in claim 50, wherein said hook of said body has a flat end and has a portion thereof engageable with said lugs of said outer sleeve increased in thickness.

52. A toner container as claimed in claim 51, wherein said mouth of said body contacts said seal member within a limited area.

53. A toner container as claimed in claim 52, wherein an annular rib is formed on said mouth of said body at a position closer to a shoulder of said body than said lugs of said outer sleeve and is engageable with the inner periphery of said outer sleeve.

54. A toner container as claimed in claim 53, wherein radial or spiral grooves are formed in a surface of said mouth of said body expected to contact said seal member and extend in a direction of rotation of said body, whereby the toner flows inward along said grooves while said body is in rotation.

55. A toner container as claimed in claim 54, wherein said spiral groove of said body has a smaller inside diameter than said mouth at a boundary between said shoulder and said mouth.

56. A toner container as claimed in claim 54, wherein said replenishing portion is at least partly formed of a transparent material.

57. A toner container as claimed in claim 50, wherein said mouth of said body contacts said seal member within a limited area.

58. A toner container as claimed in claim 57, wherein an annular rib is formed on said mouth of said body at a position closer to a shoulder of said body than said lugs of said outer sleeve and is engageable with the inner periphery of said outer sleeve.

59. A toner container as claimed in claim 58, wherein radial or spiral grooves are formed in a surface of said mouth of said body expected to contact said seal member and extend in a direction of rotation of said body, whereby the toner flows inward along said grooves while said body is in rotation.

60. A toner container as claimed in claim 59, wherein said spiral groove of said body has a smaller inside diameter than said mouth at a boundary between said shoulder and said mouth.

61. A toner container as claimed in claim 59, wherein said replenishing portion is at least partly formed of a transparent material.

62. A toner container as claimed in claim 50, wherein an annular rib is formed on said mouth of said body at a position closer to a shoulder of said body than said lugs of said outer sleeve and is engageable with the inner periphery of said outer sleeve.

63. A toner container as claimed in claim 62, wherein radial or spiral grooves are formed in a surface of said mouth of said body expected to contact said seal member and extend in a direction of rotation of said body, whereby the toner flows inward along said grooves while said body is in rotation.

64. A toner container as claimed in claim 63, wherein said spiral groove of said body has a smaller inside diameter than said mouth at a boundary between said shoulder and said mouth.

65. A toner container as claimed in claim 63, wherein said replenishing portion is at least partly formed of a transparent material.

66. A toner container as claimed in claim 50, wherein radial or spiral grooves are formed in a surface of said mouth of said body expected to contact said seal member and extend in a direction of rotation of said body, whereby the toner flows inward along said grooves while said body is in rotation.

67. A toner container as claimed in claim 66, wherein said spiral groove of said body has a smaller inside diameter than said mouth at a boundary between a shoulder of said body and said mouth.

68. A toner container as claimed in claim 66, wherein said replenishing portion is at least partly formed of a transparent material.

69. A toner container as claimed in claim 50, wherein said spiral groove of said body has a smaller inside diameter than said mouth at a boundary between a shoulder of said body and said mouth.

70. A toner container as claimed in claim 50, wherein said replenishing portion is at least partly formed of a transparent material.

71. A toner container as claimed in claim 3, wherein said hook of said body has a flat end and has a portion thereof engageble with said lugs increased in thickness.

72. A toner container as claimed in claim 71, wherein said mouth of said body contacts said seal member within a limited area.

73. A toner container as claimed in claim 72, wherein an annular rib is formed on said mouth of said body at a position closer to a shoulder of said body than said lugs of said outer sleeve and is engageable with the inner periphery of said outer sleeve.

74. A toner container as claimed in claim 73, wherein radial or spiral grooves are formed in a surface of said mouth of said body expected to contact said seal member and extend in a direction of rotation of said body, whereby the toner flows inward along said grooves while said body is in rotation.

75. A toner container as claimed in claim 74, wherein said spiral groove of said body has a smaller inside diameter than said mouth at a boundary between said shoulder and said mouth.

76. A toner container as claimed in claim 74, wherein said replenishing portion is at least partly formed of a transparent material.

77. A toner container as claimed in claim 3, wherein said mouth of said body contacts said seal member within a limited area.

78. A toner container as claimed in claim 77, wherein an annular rib is formed on said mouth of said body at a position closer to a shoulder of said body than said lugs of said outer sleeve and is engageable with the inner periphery of said outer sleeve.

79. A toner container as claimed in claim 78, wherein radial or spiral grooves are formed in a surface of said mouth of said body expected to contact said seal member and extend in a direction of rotation of said body, whereby the toner flows inward along said grooves while said body is in rotation.

80. A toner container as claimed in claim 79, wherein said spiral groove of said body has a smaller inside diameter than said mouth at a boundary between said shoulder and said mouth.

81. A toner container as claimed in claim 79, wherein said replenishing portion is at least partly formed of a transparent material.

82. A toner container as claimed in claim 2, wherein said spiral groove of said body has a smaller inside diameter than said mouth at a boundary between a shoulder of said body and said mouth.

83. A toner container as claimed in claim 2, wherein said replenishing portion is at least partly formed of a transparent material.

84. In a toner container including a body and a replenishing portion for replenishing toner stored in said toner container to a developing device, said body is hollow cylindrical and formed with a spiral groove in an inner circumferential surface thereof while said replenishing portion is hollow cylindrical and formed with an openable toner outlet in a circumferential wall thereof, said body including a mouth coaxially rotatably supported by said replenishing portion via a seal member, wherein an annular hook is formed on an outer periphery of said mouth while a plurality of lugs engageable with said hook are formed in an inner periphery of part of said replenishing portion to be connected to said body, and wherein an annular rib is formed on said mouth of said body at a position closer to a shoulder of said body than said lugs and is engageable with the inner periphery of said replenishing portion to be connected to said body.

85. A toner container as claimed in claim 84, wherein radial or spiral grooves are formed in a surface of said mouth of said body expected to contact said seal member and extend in a direction of rotation of said body, whereby the toner flows inward along said grooves while said body is in rotation.

86. A toner container as claimed in claim 85, wherein said spiral groove of said body has a smaller inside diameter than said mouth at a boundary between said shoulder and said mouth.

87. A toner container as claimed in claim 85, wherein said replenishing portion is at least partly formed of a transparent material.

88. In a toner container including a body and a replenishing portion for replenishing toner stored in said toner container to a developing device, said body is hollow cylindrical and formed with a spiral groove in an inner circumferential surface thereof while said replenishing portion is hollow cylindrical and formed with an openable toner outlet in a circumferential wall thereof, said body including a mouth coaxially rotatably supported by said replenishing portion via a seal member, wherein an annular hook is formed on an outer periphery of said mouth while a plurality of lugs engageable with said hook are formed in an inner periphery of part of said replenishing portion to be connected to said body, and wherein radial or spiral grooves are formed in a surface of said mouth of said body expected to contact said seal member and extend in a direction of rotation of said body, whereby the toner flows inward along said grooves while said body is in rotation.

89. A toner container as claimed in claim 88, wherein said spiral groove of said body has a smaller inside diameter than said mouth at a boundary between a shoulder of said body and said mouth.

90. A toner container as claimed in claim 88, wherein said replenishing portion is at least partly formed of a transparent material.

91. A toner container for use in a developing device comprising:

a body; and a replenishing portion for replenishing toner stored in said toner container to the developing device, said body being hollow cylindrical and formed with a spiral groove in an inner circumferential surface thereof and said replenishing portion is hollow cylindrical and formed with an openable toner outlet in a circumferential wall thereof, said body including a mouth coaxially rotatably supported by said replenishing portion via a seal member, wherein the openable toner outlet is selectively opened and closed by rotating the body and at least part of the replenishing portion relative to each other.

92. A toner container for use in a developing device comprising:

body means; and replenishing means for replenishing toner stored in said toner container to the developing device, said body means being hollow cylindrical and formed with a spiral groove in an inner circumferential surface thereof and said replenishing means is hollow cylindrical and formed with an openable toner outlet in a circumferential wall thereof, said body means including a mouth coaxially rotatably supported by said replenishing means via seal means, wherein the openable toner outlet is selectively opened and closed by rotating the body means and at least part of the replenishing means relative to each other.

* * * * *